US007841498B1

(12) United States Patent
Rohrer

(10) Patent No.: US 7,841,498 B1
(45) Date of Patent: Nov. 30, 2010

(54) TAPE DISPENSER FROM A SINGLE STAMPING OPERATION

(76) Inventor: Neal D. Rohrer, 725 17th St., Kenosha, WI (US) 53140

( * ) Notice: Subject to any disclaimer, the term of this patent is extended or adjusted under 35 U.S.C. 154(b) by 332 days.

(21) Appl. No.: 12/006,718

(22) Filed: Jan. 4, 2008

(51) Int. Cl.
*B65H 35/00* (2006.01)

(52) U.S. Cl. ..... 225/65; 225/56; 225/90

(58) Field of Classification Search ..... 225/25, 225/26, 56, 57, 60, 61, 65, 66, 77, 82, 88, 225/90, 91; D19/67, 69
See application file for complete search history.

(56) References Cited

U.S. PATENT DOCUMENTS

| | | | | | |
|---|---|---|---|---|---|
| D150,498 | S | * | 8/1948 | Hazelton | D19/69 |
| 2,528,958 | A | * | 11/1950 | Johnson | 225/26 |
| 2,560,394 | A | * | 7/1951 | Slezak | 225/25 |
| 2,609,877 | A | * | 9/1952 | Hanington | 225/25 |
| 2,611,432 | A | * | 9/1952 | Tallman | 225/25 |
| 2,676,658 | A | * | 4/1954 | King | 225/34 |
| 2,815,125 | A | | 11/1955 | Thompson | |
| 2,734,575 | A | * | 2/1956 | Gilbreth | 225/56 |
| 3,395,841 | A | * | 8/1968 | Brown | 225/65 |
| 3,450,318 | A | * | 6/1969 | Turner | 225/65 |
| 3,556,367 | A | * | 1/1971 | Ikeda | 225/65 |
| 3,895,059 | A | | 7/1975 | Link | |
| 3,972,459 | A | | 8/1976 | Cooper | |
| 4,627,560 | A | | 12/1986 | Samuelson | |
| 4,711,384 | A | | 12/1987 | Harris | |
| 4,961,525 | A | | 10/1990 | Corbo | |
| 5,468,332 | A | | 11/1995 | Dretzka | |
| D372,050 | S | * | 7/1996 | Ho | D19/89 |
| 5,595,626 | A | | 1/1997 | Yokouchi | |
| 5,634,580 | A | * | 6/1997 | Levy | 225/56 |
| 6,672,523 | B2 | | 1/2004 | Yamamoto | |
| 6,719,180 | B2 | | 4/2004 | Shah | |

FOREIGN PATENT DOCUMENTS

| | | | |
|---|---|---|---|
| GB | 2143505 | * | 2/1985 |

* cited by examiner

*Primary Examiner*—Laura M. Lee
(74) *Attorney, Agent, or Firm*—Atty Richard S Missimer

(57) ABSTRACT

An apparatus comprising a flexible plastic rectangular frame with a tape cutting edge; the sides of the frame flex to accommodate mounting on to a spool of pressure sensitive adhesive backed tape and are so formed as to retain the tape spool during dispensing and cutting variable lengths of the tape. The apparatus allows the tape to be dispensed upon application, cut to desired length, and upon cutting, provides capture of the supply end of the tape to ease the dispensing of additional lengths of tape. The tape spool is held within the frame by the spring tension exerted by the frame side as it is distorted during mounting of the dispenser to the tape spool.

6 Claims, 4 Drawing Sheets

TAPE DISPENSER FROM A SINGLE STAMPING OPERATION

BACKGROUND OF INVENTION

This invention relates to a tape cutting tool used to dispense pressure sensitive adhesive tape that is supplied from the tape manufacturer on cardboard cores such as is packing, strapping, drafting, masking, electrical tape or the like. This cutting tool is fabricated by a single stamping operation of plastic or metal as indicated later in this document. It is the objective of this design to minimize the cost of labor and material of manufacturing while still providing a dependable dispenser of paper or plastic tape.

DISCUSSION OF THE RELATIVE ART

There are a variety of adhesive tape dispensers designs intended for mounting on to or enclosing a tape roll to provide operator-held use. U.S. Pat. Nos. 2,815,125 (Thompson, 1955), 3,895,059 (Link, 1975), and 5,595,626 (Yokouchi, 1997) are examples of designs that totally enclose the adhesive tape roll, with the tape available through a single exit. These dispensers provide protection from environmental contaminates, protect the user from potentially sharp edges of the tape and may provide aid in applying the tape in a desired position while dispensed. However, they may suffer from inability to assure a ready supply of tape if the tape adhesive were to adhere to the internal mechanism.

U.S. Pat. Nos. 3,972,459 (Cooper, 1976), 4,627,560 (Samuelson, 1986), 4,961,525 (Corbo, 1990), 5,468,332 (Dretzka, et al., 1995), and 6,672,523 (Huang, 2004), and 6,719,180 (Shah, 2004) are representative of devices that mount to rolls of adhesive tape of various widths and diameters but do not completely enclose the roll. These types of devices are mounted to a tape roll by separating the sides, thus allowing the roll to be positioned and subsequently captured by the quiescent geometry of the dispenser or by a latching mechanism locking the tape roll between the sides. Since these dispensers do not enclose the roll, the tape is exposed to the environment but the tape is more accessible.

BRIEF SUMMARY OF THE INVENTION

A tape dispensing apparatus comprising a flexible rectangular frame with a tape cutting edge; a side wall of the frame flexes to accommodate mounting on to a spool of pressure sensitive adhesive backed tape and are so formed as to retain the tape spool during dispensing and cutting variable lengths of the tape. The apparatus allows the tape to be dispensed prior to application, cut to desired length, and upon cutting, provides capture of the supply end of the tape to ease the dispensing of additional lengths of tape. The tape spool is held within the frame by the spring tension exerted by the frame side wall as it is distorted during mounting of the tape dispenser to the tape spool.

The previous art generally suffers from a disadvantage: relative complexity. Most tape dispensers require the fabrication of multiple components and/or multiple manufacturing processes, resulting in higher costs. The present invention requires minimal manufacturing processes as the basic fabrication, including the formation of the cutting edge, is accomplished through a single sheet-stamping process.

DRAWINGS

Reference Numerals

100—Frame
101—First end wall
102—First side wall
103—Cutter end wall
104—Second side wall
105—Guide tab
106—Safety Edge
107—Cutter portion

DETAIL DESCRIPTION OF THE INVENTION

Figure 1:
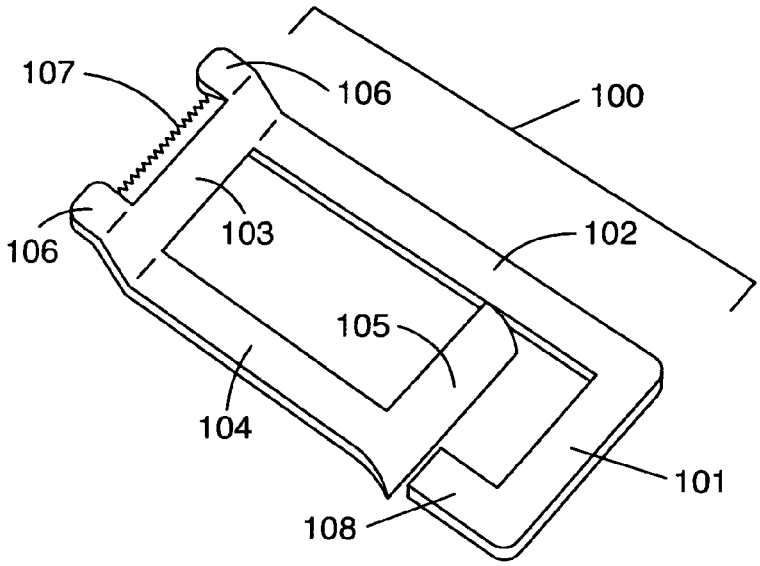
FIG. 1 is a top perspective view illustrating a plastic tape dispenser.
Figure 2:
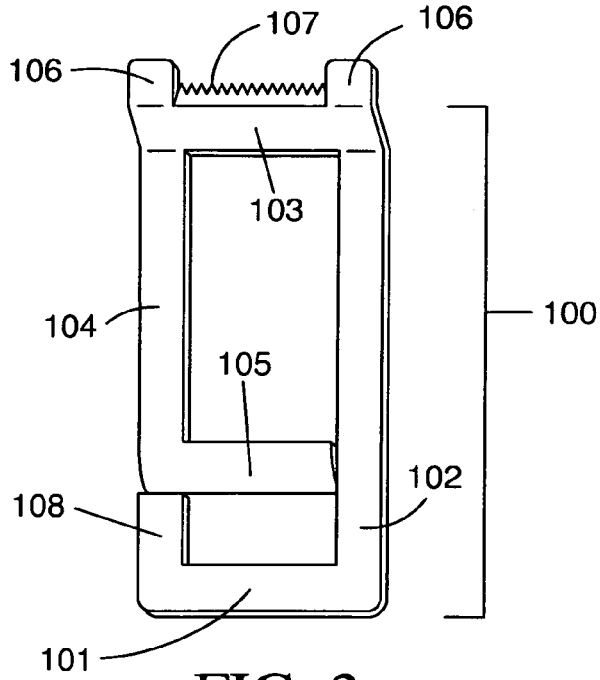
FIG. 2 is a top view of a plastic tape dispenser.

FIG. 1 illustrates an example of a preferred embodiment of the present invention. The tape dispenser has a frame 100 that is integrally molded with cutter portion 107 on the cutter end wall 103 of the frame 100. Frame 100 can be manufactured by a single stamping operation made out of, for example without limitation, elastic plastic or metals, while cutter portion 107 could consist of a thin metal blade added later in the manufacturing process or metal or plastic that has been incorporated into the stamping operations, any of which may be serrated. Safety edges 106 extend outwardly on both sides of cutter portion 107. Safety edges 106 help protect the user from getting cut by cutter portion 107 while operating the tape dispenser.

The second side wall 104 of frame 100 has a guide tab 105 that runs from the end of second side wall 104 extending towards the first side wall 102 of frame 100. The guide tab 105 is located between the second side wall 104 and the third guide wall 108

Figure 3:
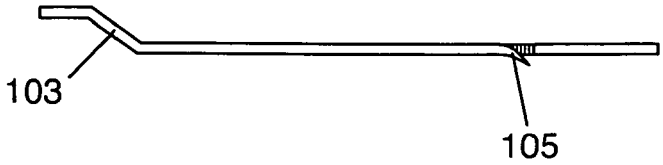
FIG. 3 is a left view of a plastic tape dispenser.
Figure 4:
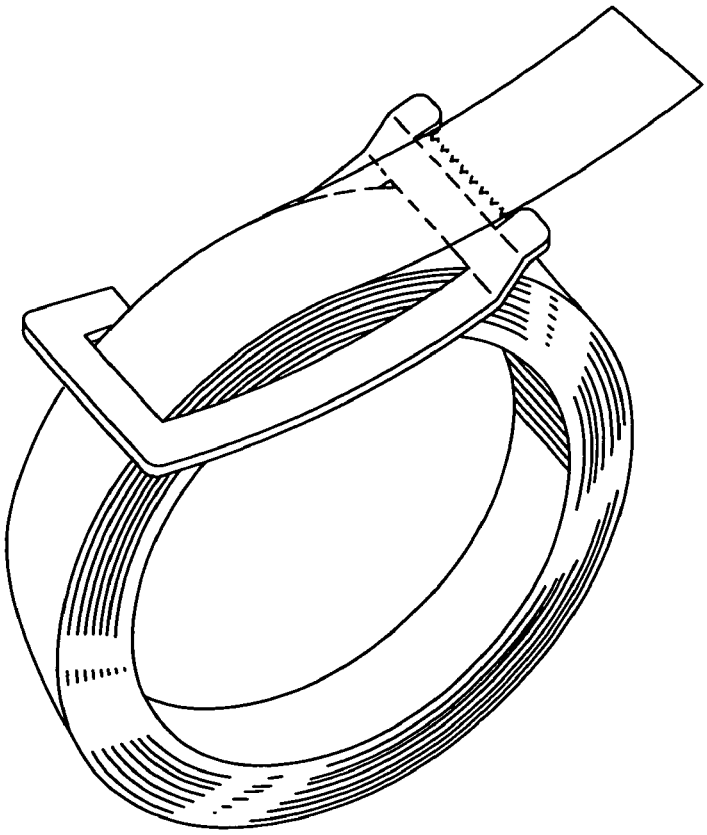
FIGS. 4-6 illustrate a plastic tape dispenser engaged with a tape spool.
Figure 5:
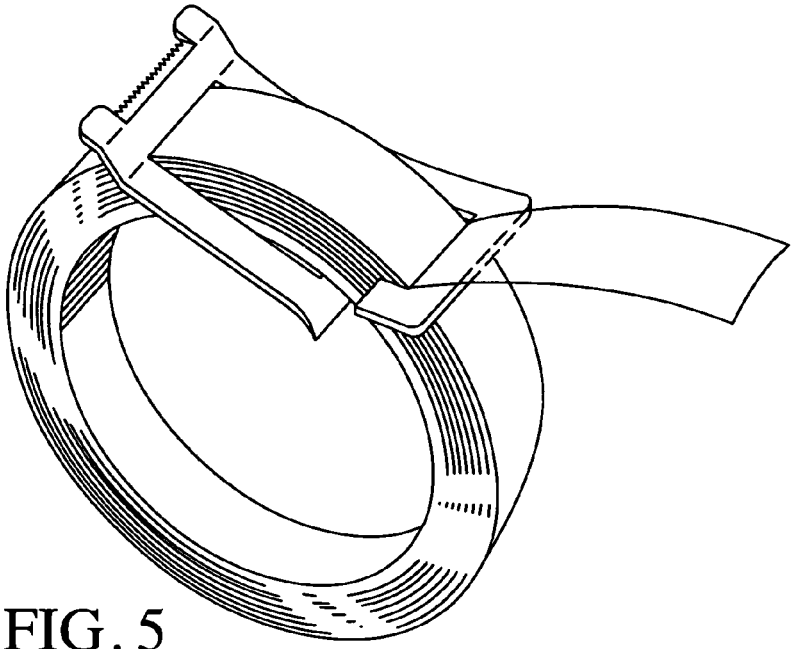
Figure 6:
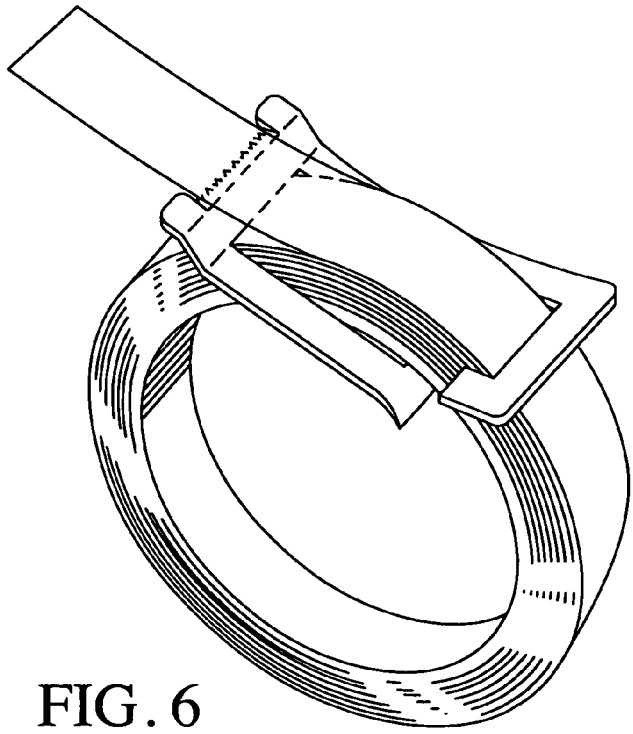
Figure 7:
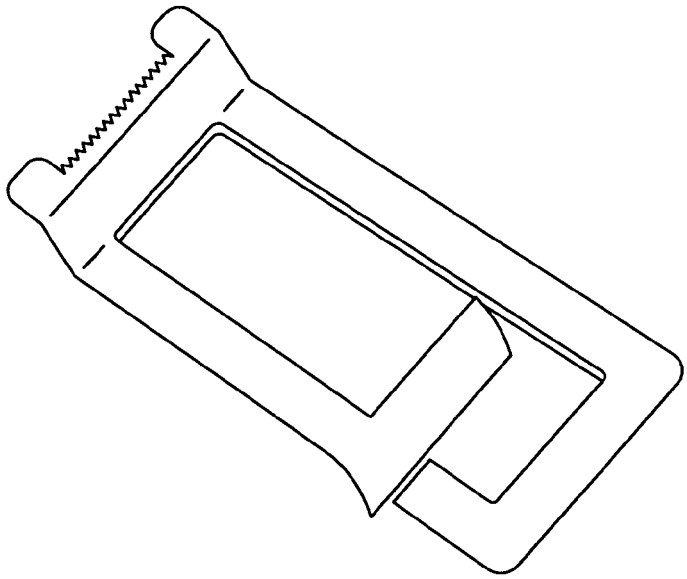
FIG. 7 is a top perspective view illustrating a metal tape dispenser.
Figure 8:
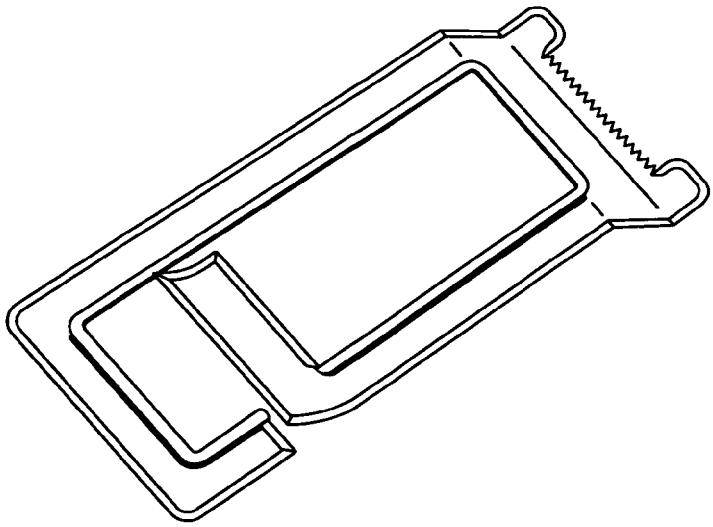
FIG. 8 is a bottom perspective view illustrating a metal tape dispenser.

The guide tab 105 is slightly curved as can be seen more clearly in FIG. 3, in order to facilitate movement along the inner dimensions of a tape spool when a user is measuring out a length of adhesive-backed tape in order to dispense the tape. FIGS. 4-5 illustrate tape dispenser engaged with a tape spool. The guide tab 105 is made of the same elastic material that frame 100 is made of as a result of a single stamping operation. The elasticity of the second side wall 104 allows for the user to bend the guide tab 105 toward the center of the tape spool as a step in engaging and locking the tape dispenser with the tape spool. Once the tape spool is engaged, the spring tension exerted by the second side wall 104 as it is distorted during mounting of the dispenser to the tape spool keeps the tape dispenser in place.

The first end wall 101, which is on the opposite end of cutter end wall 103, helps the user dispense pressure sensitive adhesive-backed tape. The tape can be dispensed by the user as the user pulls one end of the tape in the direction the first end wall 101 is oriented in, as tape dispenser will move in that direction as well. Once the user has measured out the desired amount of tape to dispense, the user can take the end of the adhesive-backed tape and move it towards the cutter portion 107 of cutter end wall 103. The cutter portion 107 will cut through the tape and allow the tape to be dispensed. Upon cutting, the cutter portion 107 will also capture the supply end of the adhesive-backed tape to ease the dispensing of additional tape.

More specifically, cutter end wall 103 is in a plane at an angle to frame 100, oriented away from the tape spool creating an elevating bend, which is best illustrated in FIG. 3. The elevating bend of the cutter end wall 103 allows the user to dispense the tape at a higher contact point, resulting in dispensing with less effort and a higher efficiency.

The present invention has been described with reference to one preferred embodiment thereof. It will be apparent to those skilled in the art that many changes can be made without departing from the scope of the present invention. It is intended that any modifications to the present embodiment be included insofar as such modifications come within the scope of the claims and any equivalents thereof.

I claim:

1. A tape dispenser comprising:

A. a substantially rectangular and planar frame comprising:

a first end wall that provides alignment to the tape spool and provides tension contact to maintain mounting to the tape spool;

a first side wall that connects perpendicularly to said first end wall;

a cutter end wall that connects perpendicularly to the first side wall, that has an upward bend from the plane of the first side wall and first end wall, that also provides alignment to the tape spool and also provides tension contact to maintain mounting to the tape spool;

a second side wall that connects perpendicularly to the cutter end wall, is parallel to said first side wall, and provides spring tension to hold the frame to the tape spool; a third side wall that connects perpendicularly to the first end wall and is parallel to the first side wall and is parallel to or aligned with the second side wall; and a guide tab, which is perpendicularly connected to the second side wall and is parallel to the first end wall and is in the same plane as said first end wall while unattached, but is used to provide contact tension to the inner surface of the tape spool while attached to the tape spool, and wherein the guide tab is situated between the second side wall and the third side wall;

B. a cutter portion attached to the cutter end wall of the frame allowing for cutting tape and for capture of a supply end of tape, said cutter end wall is bent to allow for the cutter to be placed at a higher point in reference to the frame; and C. two safety edges attached to the cutter end wall, which protects the user from the cutter portion exposure;

whereby the dispenser is attached to the tape spool by exerting pressure to the combination of the two end walls and the guide tab, thereby distorting the second side wall while the tape dispenser is mounted to the tape spool, the dispenser being secured to the tape spool by the exertion of the combined downwards pressure of the of the two end walls on the outer surface of the tape spool and the opposing upwards pressure exerted by the guide tab on the inner surface of the tape spool.

2. A tape dispenser as in claim 1, wherein said frame is flexible plastic, such as a polymeric material.

3. A tape dispenser as in claim 2, wherein said cutter portion is made of metal.

4. A tape dispenser as in claim 1, wherein said frame is made of a metal.

5. A tape dispenser as in claim 4, wherein said frame is formed in a single stamped operation.

6. A tape dispenser as in claim 3, wherein said frame is formed in a single stamped operation

* * * * *